United States Patent [19]

Bowditch

[11] 4,401,044

[45] Aug. 30, 1983

[54] SYSTEM AND METHOD FOR MANUFACTURING SEAMED ARTICLES

[75] Inventor: Philip N. Bowditch, Cohasset, Mass.

[73] Assignee: The Charles Stark Draper Laboratory, Inc., Cambridge, Mass.

[21] Appl. No.: 231,381

[22] Filed: Feb. 4, 1981

[51] Int. Cl.[3] ..... D05B 97/00; D05B 21/00

[52] U.S. Cl. ..... 112/262.3; 112/121.12; 2/243 R; 156/93

[58] Field of Search ..... 112/262.3, 121.12, 121.5, 112/121.14, 121.11; 2/243 R, 243 B, 402, 404, 406, 407, 79, 115, DIG. 7; 156/93

[56] References Cited

U.S. PATENT DOCUMENTS

| | | | |
|---|---|---|---|
| 2,494,169 | 1/1950 | Formichella | 2/404 |
| 2,896,219 | 7/1959 | Clyne | 2/404 |
| 3,500,479 | 3/1970 | Pierron | 2/79 |
| 3,574,238 | 4/1971 | McCurry | 2/243 R |
| 3,585,641 | 6/1971 | Pierron | 2/79 |
| 3,594,821 | 7/1971 | Pierron | 2/243 R X |
| 3,678,516 | 7/1972 | Backer | 2/243 R |
| 3,701,165 | 10/1972 | Huddleston | 2/243 R |
| 3,798,678 | 3/1974 | Pierron et al. | 2/243 R |
| 3,869,997 | 3/1975 | German | 112/121.12 |
| 3,896,749 | 7/1975 | Brauns et al. | 112/121.12 |
| 4,055,859 | 11/1977 | Green et al. | 2/243 R |

*Primary Examiner*—H. Hampton Hunter
*Attorney, Agent, or Firm*—Lahive & Cockfield

[57] ABSTRACT

A method and system for manufacturing articles from a strip of flexible material, when the article is characterized by one or more seams joining an associated set of non-colinear curvilinear segments. Initially, the strip of material is positioned so that the curvilinear segments for one seam are mutually adjacent and then those segments are joined. Thereafter, excess material is removed.

8 Claims, 4 Drawing Figures

SYSTEM AND METHOD FOR MANUFACTURING SEAMED ARTICLES

BACKGROUND OF THE INVENTION

The present invention is in the field of automated assembly devices, and more particularly relates to systems and methods for manufacturing seamed articles from flexible material.

In the prior art, seamed articles made from flexible materials are generally manufactured by cutting out various panels of the article from the material, and then joining those panels along edges, forming seams, to produce the final article. For example, in the manufacture of clothing, where the material is generally relatively limp and also stretchable, an article is generally produced by cutting, and subsequently joining panels of cloth in such a manner so that a desired three-dimensional fit is achieved. In the simplest form, the skin of an animal may be considered to be an example of an optimal three-dimensional fit of "clothing". To reproduce this "clothing", with such a fit, the animal's skin may be removed and then cut and stretched to form substantially planar panels. By arranging these panels as patterns on a bolt of flexible material, a series of geometric outlines may be generated on the material which define the panels and seams (which are a function of the original animal's geometry) and a plurality of "void" areas outside of the seams and between the panels. In accordance with conventional clothing manufacture, the various panels may be then cut from the bolt of material and joined at the peripheries, forming seams, and easing where necessary, to reconstruct the clothing article having the three-dimensional skin geometry of the original animal.

In recent years, there have been numerous advancements in the art of clothing manufacture. Such improvements include computer controlled techniques for determining the placement and cutting of panel patterns on the material from a bolt, to provide optimal fabric usage. Another improvement is directed to the use of computer controlled elements for cutting multiple sets of panels at a time. However, in spite of these improvements, the basic construction technique for seamed articles has remained the same; the panels are first cut and then assembled subsequently to form the article. Typically, in the clothing manufacture industry, this process results in a relatively labor intensive manufacturing process, where much of the labor of assembling the precut panels is performed manually.

It is an object of the present invention to provide an improved method and system for manufacturing of seamed articles from flexible material.

SUMMARY OF THE INVENTION

Briefly, the present invention is a method and system for the manufacture of a seamed article from a strip of flexible material, where the article is formed by generating one or more of the seams of the article prior to the cutting of the material. In one form of the invention, an article characterized by one or more seams may be manufactured from the bolt of material. Each seam joins an associated set of non-colinear curvilinear segments of the bolt of material. In accordance with the invention, the material is first received from the bolt and then positioned so that at least one set of the curvilinear segments for one seam are mutually adjacent. Those adjacent curvilinear segments for that seam are then joined, for example, by sewing, or by fusing. Where a conventional two-dimensional sewing head (or other form of joining head), it will be understood that a set of three-dimensional curvilinear segments-to-be-joined initially are converted to a corresponding set of two-dimensional curvilinear segments (for example by the use of temporary two-dimensional darting).

In one form of the invention, a system includes a position signal generator for generating a signal representative of the position of the bolt of material, and portions thereof, relative to a seam joining head. The system further includes a device for receiving and storing data representative of the location of the sets of curvilinear segments on the material and the seams with which those sets are associated. A system controller is responsive to the position signal and the stored data to drive the joining head to accomplish the joining operation. Following the joining operation, excess material (i.e. the "void" areas between the panel patterns on the material) may be cut away from the material of the bolt.

Generally, the system and method of the present invention calls for joining seams before the material is cut. While in some senses, this approach may be somewhat wasteful of fabric in comparison to prior art approaches which "optimally" use fabric in terms of panel organization and cutting, the present invention permits relatively easy fabrication of the article following the formation of many, some, or all of the seams, darts, vents, and the like, in the material from the bolt prior to any cutting operation. As a consequence, the elimination of many or all of these labor intensive panel assembly steps is achieved, with the relatively minor, if any, expense of non-optimum fabric usage.

BRIEF DESCRIPTION OF THE DRAWINGS

The foregoing and other objects of this invention, the various features thereof, as well as the invention itself, may be more fully understood from the following description, when read together with the accompanying drawings in which.

DESCRIPTION OF THE PREFERRED EMBODIMENT

Figure 1:
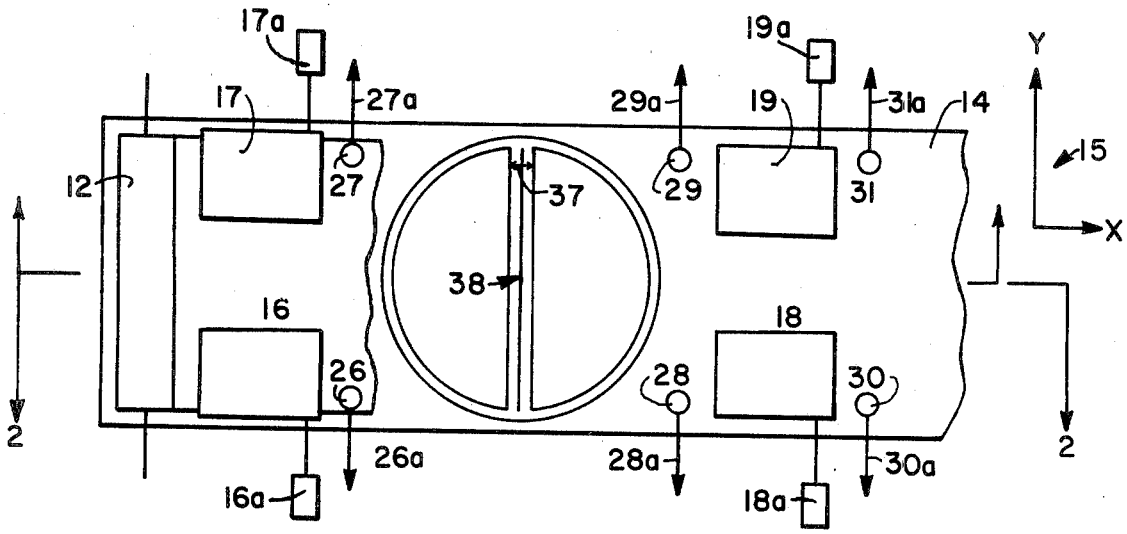
FIGS. 1 and 2 show an exemplary embodiment of the present invention.
Figure 2:
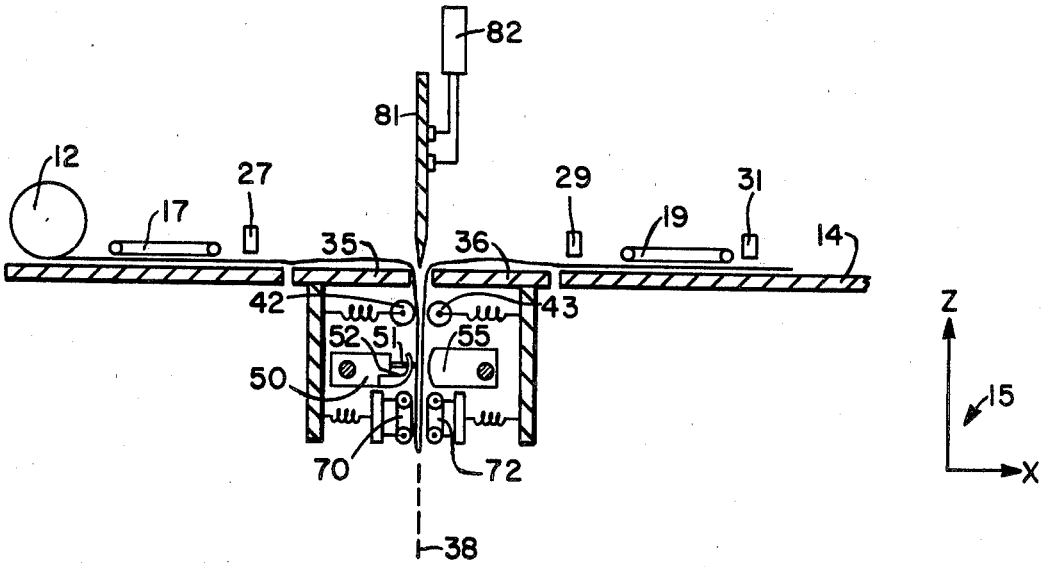
Figure 3:
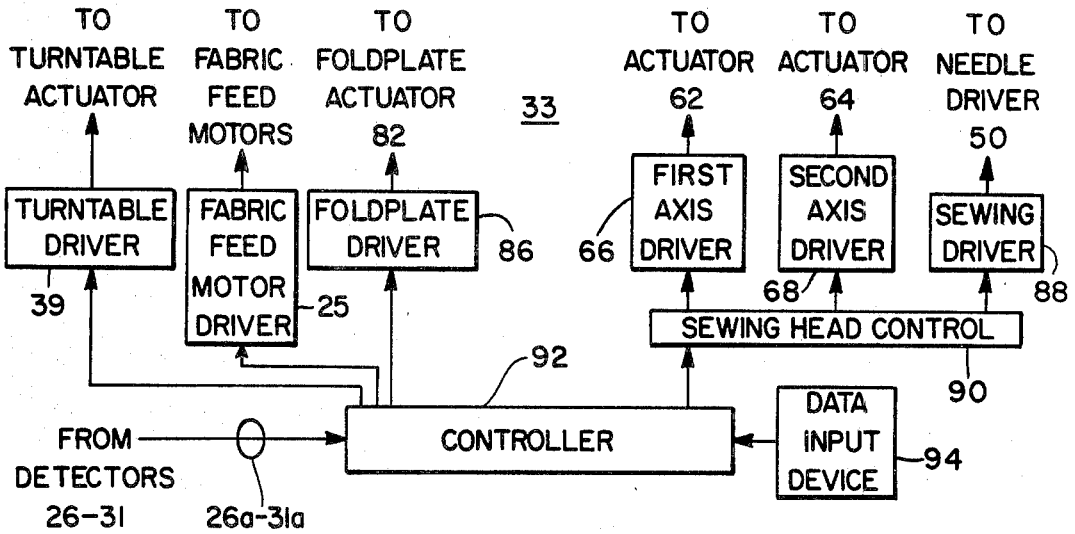
FIG. 3 shows, in block diagram form, the system control network for the embodiment of FIGS. 1 and 2.

FIGS. 1–3 show an exemplary system embodying the present invention. In those figures, an end of a bolt of material 12 is shown on a flat surface 14, in relation to an X-Y-Z coordinate system 15. Two pairs of fabric feed assemblies 16, 17 and 18, 19 are positioned so that the material from the end of bolt 12 may pass successively between those pairs of assemblies and the surface 14 as the material leaves the bolt 12. Each of fabric feed assemblies 16–19 has an associated one of fabric feed motors **16*a*–19*a* adapted to selectively drive its associated feed assembly so that the end of bolt 12 may be selectively fed in the X direction as indicated in FIGS. 1 and 2**.

A set of detectors 26 through 31 is positioned over surface 14. These detectors provide signals on the respective ones of lines **26*a* through 31*a* and representative of a deleted characteristic of the material from bolt 12** when that material underlies the detectors. By way of example, the material may be embossed on its edges with bar code symbols representing the distance along the material.

As described more fully in conjunction with FIG. 3 below, a system control network 33 controls motors 16a–19a (by way of a fabric feed motor driver 25) and detectors 26–31 in order to provide a controlled feed of the fabric from bolt 12 in the X or Y direction, or both X and Y directions, where the detectors 26–31 provide feedback to network 33 indicating the presence or absence of material from bolt 12 under those respective detector elements. This information is used to determine registration of the material from bolt 12. Of course, in other embodiments, different methods of feeding material from bolt 12 and registering that material with respect to a spatial coordinate reference system may be utilized.

The exemplary system further includes a turntable assembly having two semi-circular top surfaces 35 and 36 flush with surface 14 and separated by a gap 37. The turntable assembly is selectively rotatable about an axis 38 by an actuator (not shown) in response to control signals from a driver 39 in network 33. The turntable assembly includes a pair of spring-biased, opposed rollers 42 and 43 positioned below and parallel to the longitudinal axis of gap 37. A sewing head assembly (including a unit including needle driver 50, needle 51, presser foot 52 and a unit including a shuttle assembly 55) is coupled to the turntable. The sewing head assembly is a conventional sewing head, and is mounted on a carriage (not shown) driven by actuators 62 and 64 (not shown). The sewing head assembly further includes a pair of opposed rollers (not shown) rotatable about axes parallel to the Z axis. These roller pairs are displaced in the Y axis from and on each side of the needle 51, and they control the fabric between their respective rollers before and after the needle 51 on the sensing head assembly traverses the folded material in the Y and Z directions. This configuration provides selective independent movements of the sewing head assembly along respective ones of two orthogonal axes, one axis being parallel to axis 38, and the other axis being parallel to the longitudinal axis of gap 37. First axis driver 66 and second axis driver 68 of the control network 33 drive actuators 62 and 64. A pair of spring biased, opposed fabric driver assemblies 70 and 72 are positioned below the sewing head assembly.

The turntable assembly further includes a selectively controlled fold plate 81 and associated actuator 82. Fold plate 81 is adapted for translational and rotational motion (controlled by actuator 82, which in turn is controlled by fold plate driver 86 of network 33) in a plane perpendicular to top surface elements 35 and 36 of the turntable and through the longitudinal axis of gap 37. In operation, the fold plate 81 is selectively driven through the gap 37 to establish a fold in the material from bolt 12 so that two desired contours on that material are overlaid between the needle driver 50 and shuttle 55.

FIG. 3 shows the system control network 33 for the electro-mechanical system shown in FIGS. 1 and 2. This network 33 includes turntable driver 39 (which is electrically coupled to the turntable actuator), the fabric feed actuator driver 25 (which is electrically coupled to drive the motors 17a, 19a and the motors associated with feed assemblies 70 and 72), fold plate actuator driver 86 (which is electrically coupled to the fold plate actuator 82), first axis driver 66 and second axis driver 68 (which are electrically coupled to the respective actuators 62 and 64) and a sewing driver 88 (which is electrically coupled to the needle driver 50). The network 33 further includes a sewing head control 90 and an overall system controller 92 and an associated data input device 94.

Generally, the controller 92 may have the form of a programmed digital computer adapted to receive input data by way of device 94 which indicates locations of curvilinear segments of that material which are to be joined to form a seam on the material from bolt 12. The program in the controller 92 is adapted to identify various curvilinear segments on the material which are desired to be joined to form a seam, and to actuate the fold plate assembly in a manner folding the material so that the desired curvilinear segments overlie each other in the vertical plane passing through gap 37 and between the needle driver 50 and shuttle 55 of the sewing head assembly.

Figure 4:
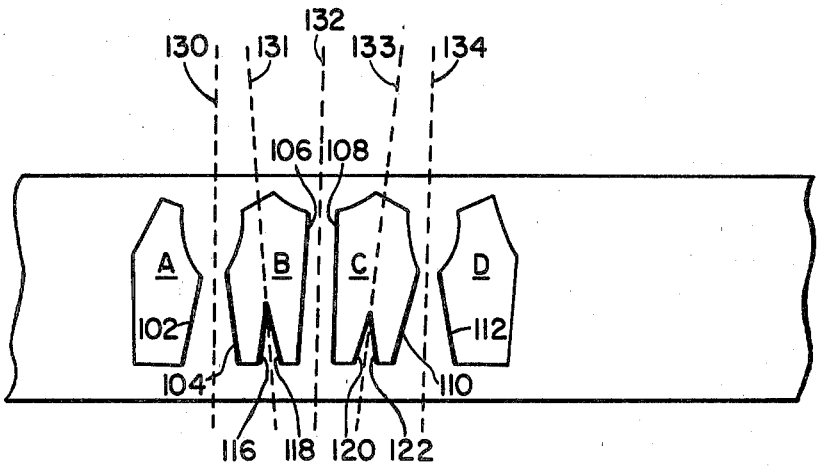
FIG. 4 shows an exemplary pattern for a seamed article to be assembled in part by the embodiment of FIGS. 1 and 2.

FIG. 4 illustrates a strip of material having an exemplary four-piece pattern for an article-to-be-assembled. In this example, the article is a vest and includes four pierce denoted A, B, C and D. In the assembled vest, the curvilinear segments 102 and 104 on the material are to be joined to form one seam, the segments 106 and 108 are to form another seam, and the segments 110 and 112 are to form a third seam. The addition, the segments 116 and 118 are to be joined to form a seam, establishing a first dart, and the segments 120 and 122 are to be joined to form a second dart. Each of these seams is associated with one of the broken lines 130–134 which is symmetrically positioned between the two segments of that seam.

In operation, to form one of these seams, as the material from bolt 12 is drawn across the turntable by assemblies 16–19, the network 33 rotates the turntable so that the gap 37 is aligned with the associated one of lines 130–134. The assemblies 16–19 are then raised from surface 14 and the fold plate 81 is driven through the gap in a manner forcing the material through the gap so that the desired curvilinear segments are overlaid within the dynamic range of the sewing head on its carriage.

Following this alignment of the material, as indicated in FIG. 1, the fold plate 81 is retracted to permit operation of the sewing head along the overlaid segments. The sewing head is then adjustably positioned and actuated by sewing driver 88 to sew along the desired contour. The sewing head control 90 generally coordinates the operation of the actuators 62 and 64 and the sewing head. In alternative embodiments, the sewing head may, for example, be replaced by a device for fusing the layers of material along the desired contour. This is particularly useful where the material from bolt 12 is a plastic material which may, for example, be heat fusable. In yet other embodiments, differing forms of folding mechanisms may be used for the system 10, for example, a material gathering system which would gather in wrinkles extending in the plane perpendicular to the X-Y plane for sewing with a sewing head which is movable in three dimensions.

Following the sewing operation for a seam, the assemblies 16–19 are again biased against surface 14 and are driven to move the material across the turntable so that the next seam may be sewn. In some cases, the assemblies may achieve the desired alignment of the material with a succession of +X and −X directed motions.

Accordingly, with the illustrated form of the invention, for example, the cloth from a bolt of material is first fed onto a flat surface 14, the cloth is then folded over into the gap 37 by the retractable, fold plate 81 so that the curvilinear segments of the material desired to form one seam are mutually adjacent, one next to the other. The folded material is then presented to a programmable two-axis sewing head in a plane by the rollers 42 and 43 and drive assemblies 70 and 72. At that time, stitching is performed to generate the seam of the final desired geometry. In various forms of the invention, differential sewing may be utilized to provide modifications from the initially indicated curvilinear segments, to permit custom tailored fullness. These variations may be readily accomplished by simple input procedures to the system controller, in some forms of the invention in the form of spatial contour points representative of the geometry of the person for whom the clothing article is being manufactured.

In order to provide such coordinates, the invention further provides for instrumentation for generating such coordinates, for example, in the form of an instrumented body sock, which a person could wear for extraction of this information. Subsequently, the body surface coordinates of the person are stored on digital tape cassette, and provide a representation of his personalized fitment. This data is stored on the cassette in a codable form suitable for use with the programmable sewing procedure which is presented to the control system of the invention.

Following a sewing operation, rollers 42 and 43 and drive assemblies 70 and 72 are controlled to eject the folded (and sewn) material from gap 37. Thereafter, other seams may be similarly fashioned using the system, and in some forms, fusing and pressing of the selvage can be performed using conventional techniques. Moreover, excess material may also be cut away after the sewing operation, either manually or by machine techniques.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

I claim:

1. A system for manufacturing articles from an elongated strip of material having an associated reference axis in its elongated dimension, said article being characterized by one or more seams, each seam joining an associated set of non-colinear curvilinear segments of said strip of material, comprising folding means for receiving said strip of material in the direction of said reference axis, said folding means including means for folding said strip of material along a fold axis, said fold axis being between said associated set of non-colinear curvilinear segments and being angularly offset from said reference axis, whereby at least one set of curvilinear segments for one seam are mutually adjacent, joining means including a joining head for joining said adjacent set of curvilinear segments for at least one seam, and cutting means operative after said joining means, said cutting means including means for cutting portions of said material adjacent to said joined segments and not a part of said article.

2. A system according to claim 1 wherein said joining head includes means for fusing said material along a set of said curvilinear segments associated with said seam.

3. A system according to claim 1 wherein said joining head includes means for sewing said material along a set of said curvilinear segments associated with said seam.

4. A system according to claim 1 further comprising:

means for generating a position signal representative of the position of said strip of material relative to said joining head, means for receiving and storing data representative of the location of said sets of curvilinear segments on said material and representative of the seams associated with said sets, and control means responsive to said position signal and said stored data to drive said joining head.

5. A method for manufacturing articles from an elongated strip of material having an associated reference axis in the elongated dimension, said articles being characterized by one or more seams, each seam joining an associated set of non-colinear curvilinear segments of said strip of material, comprising the sequential steps of:

A. receiving said strip of material in the direction of said reference axis and folding said strip of material along a fold axis, said fold axis being between said associated set of non-colinear curvilinear segments and being angularly offset from said reference axis, whereby at least one set of curvilinear segments for one seam are mutually adjacent, B. joining said adjacent set of curvilinear segments for at least one seam, and C. cutting portions of said material adjacent to said joined segments and not a part of said article.

6. The method according to claim 5 wherein said joining step includes the step of sewing said material along a set of said curvilinear segments associated with said seam.

7. The method according to claim 5 wherein said joining step includes the step of fusing said material along a set of said curvilinear segments associated with said seam.

8. The method according to claim 5 including the steps of:

generating a position signal representative of the position of said strip of material during said steps A and B, receiving prior to step A or at least during and storing data representative of the location of said sets of curvilinear segments on said material and representative of the seams associated with said sets, controlling said step B in response to said position signal and said stored data.

* * * * *